US006672719B2

(12) United States Patent
Sumi et al.

(10) Patent No.: US 6,672,719 B2
(45) Date of Patent: Jan. 6, 2004

(54) THERMAL DEVELOPING APPARATUS AND ASSEMBLING METHOD THEREOF

(75) Inventors: Makoto Sumi, Saitama (JP); Akira Taguchi, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/199,223

(22) Filed: Jul. 19, 2002

(65) Prior Publication Data

US 2003/0025776 A1 Feb. 6, 2003

(30) Foreign Application Priority Data

Jul. 31, 2001 (JP) ..... 2001-230854

(51) Int. Cl.[7] ..... B41J 2/01
(52) U.S. Cl. ..... 347/103
(58) Field of Search ..... 347/103, 101, 347/1; 430/253, 252, 199, 348; 346/76.1

(56) References Cited

U.S. PATENT DOCUMENTS 6,514,662 B2 * 2/2003 Ito

* cited by examiner

*Primary Examiner*—Raquel Yvette Gordon
(74) *Attorney, Agent, or Firm*—Squire, Sanders & Dempsey

(57) ABSTRACT

A thermal developing apparatus in which a photothermographic element having a latent image is interposed between a heated member and a plurality of guiding rollers and when the photothermographic element is conveyed and heated while the guiding rollers are rotated, the thermal developing is conducted, and the visible image is obtained, a plurality of guiding rollers are arranged so that the variation cycle of the radius of each guiding roller is not synchronized with each other on the photothermographichic element during the rotation of each guiding roller.

7 Claims, 11 Drawing Sheets

THERMAL DEVELOPING APPARATUS AND ASSEMBLING METHOD THEREOF

BACKGROUND OF THE INVENTION

The present invention relates to a thermal developing apparatus to thermally develop a photothermographic element and an assembling method thereof, and particularly, it is suitable when the present invention is applied to a medical image output apparatus.

A thermal developing apparatus which is heated while the photothermographic film is being interposed between a heated drum and a plurality of guiding rollers arranged around its periphery, and conveyed, in order to thermally develop the photothermographic film on which a latent image is formed by a laser exposure, is widely known. In such a thermal developing apparatus, the rollers are guided toward the heated drum, and the film is pressed onto the heated drum while the rollers are rotated at the time of thermally developing.

In this connection, the inventors discovered that in such a thermal developing apparatus, there is a case where the guiding roller is decentered due to the fluctuation at the time of production, and the photothermographic film is not uniformly pressed due to so-called the eccentricity of the guiding roller, and the adhesion of the photothermographic film becomes non-uniform, and the thermal energy which is obtained by the film from the heated drum is not uniform, and the uneven development is easily generated.

Further, at the time of the production of the apparatus or the assembling of the guiding roller in the cleaning or replacement in the maintenance, the degree of the uneven development is changed and fluctuated due to the condition of the arrangement of the rollers, and the reproducibility of the image quality is lost, and it is not preferable.

SUMMARY OF THE INVENTION

In view of the problems of the above-described conventional technology, the object of the present invention is to provide a thermal developing apparatus and an assembling method thereof in which the thermal energy which is obtained by the photothermographic element from the heated drum is uniformed, the fluctuation of the uneven development for each apparatus can be decreased, and the reproducibility and stability of the image quality at the time of the production and the maintenance of the apparatus can be secured.

In order to attain the above object, the first thermal developing apparatus according to the present invention is characterized in that: a thermal developing apparatus in which a photothermographic element having a latent image to obtain a visible image, includes a heated member positioned to receive the photothermographic element and to heat the photothermographic element for developing an image on the photothermographic element and a plurality of guiding rollers positioned at guiding positions adjacent the heated member for guiding the photothermographic element against the heated member, wherein the photothermographic element is transported between the heated member and the guiding rollers while the guiding rollers rotate, and the plurality of guiding rollers are arranged so that a variation cycle of the radius of each guiding roller is not synchronized with each other on the photothermographic element while the guiding rollers rotate. The variation cycle of the radius represents eccentricity of each roller (referred to JIS B0021-1974) which can be measured by, for example, a laser micro-measuring instrument or the like.

According to this thermal developing apparatus, even when the plurality of guiding rollers are respectively decentered, because the variation cycles are not synchronized, the radius variation is cancelled as a whole on the photothermographic element during the rotation of the plurality of guiding rollers, and the photothermographic element is more uniformly pressed onto the heated member as the whole by the plurality of guiding rollers. Therefore, the thermal energy obtained by the photothermographic element from the heated member becomes constant, and the uneven development is hardly generated.

Further, when a drive transmission means is provided between the heated member and the plurality of guiding rollers, because the guiding roller does not slip during the rotation, the arrangement of the plurality of guiding rollers which is made so that the variation cycle of the radius is not synchronized with each other, is not disordered.

Further, when a reference marker at which the phase of the variation cycle of the radius of each guiding roller is adjusted on the photothermographic element, is respectively provided on the plurality of guiding rollers, because the reference marker becomes an index when the reference marker positions each guiding roller at the time of the assembling, the reproducibility of the arrangement of the guiding roller is increased, and the reproducibility and the stability of the image quality can be secured at the time of the production and the maintenance of the apparatus. In this connection, the reference marker can be provided, for example, at the circumferential position at which the radius of the guiding roller is largest by the printing, or stamping.

Further, the second thermal developing apparatus according to the present invention is characterized in that: a thermal developing apparatus in which a photothermographic element having a latent image to obtain a visible image, includes a heated member positioned to receive the photothermographic element and to heat the photothermographic element for developing an image on the photothermographic element and a plurality of guiding rollers positioned at guiding positions adjacent the heated member for guiding the photothermographic element against the heated member, wherein the photothermographic element is transported between the heated member and the guiding rollers while the guiding rollers rotate, when the diameter of the guiding roller is defined as $\Phi$, and the radius variation value of each guiding roller is defined as $\sigma$, the following expression is satisfied.

$$\sigma<\Phi\times 0.1/12$$

According to this thermal developing apparatus, when the radius variation value $\sigma$ of a plurality of guiding rollers is within the range satisfying the above expression to the diameter $\Phi$, because the photothermographic element is uniformly pressed onto the heated member by the plurality of guiding rollers, the thermal energy obtained by the photothermographic element from the heated member becomes constant, and the uneven development is hardly generated.

In this case, when the diameters of the plurality of guiding rollers are made respectively different, even when the plurality of guiding rollers are respectively decentered, because the variation cycles are not synchronized, the radius variation on the photothermographic element is cancelled as the whole during the rotation of the plurality of guiding rollers, and thereby, the photothermographic element is more uniformly pressed as a whole onto the heated member by the plurality of guiding rollers. In this connection, the plurality of guiding rollers whose diameters are different, may be arranged randomly and their assembling becomes easy.

Further, in an assembling method of the thermal developing apparatus according to the present invention, at the assembling at the time of the production or maintenance of the first thermal developing apparatus mentioned above in which the reference marker is provided on the plurality of guiding rollers, when the phase of the variation cycle of the radius of each guiding roller is adjusted and the plurality of rollers are arranged according to the reference marker, because the reference marker can be made an index for positioning at the time of the assembling of each guiding roller, the phase adjustment for each guiding roller becomes simple, and the assembling of the guiding roller becomes easy. Thereby, the reproducibility of the arrangement of the guiding roller is increased, and the reproducibility and stability of the image quality at the time of the production and the maintenance of the apparatus can be secured.

In this case, it is preferable that the diameter of each guiding roller is measured at the time of production of the thermal developing apparatus, and according to the measured value, the reference marker is provided.

DETAILED DESCRIPTION OF THE PREFERRED EMBODIMENT

Figure 1:
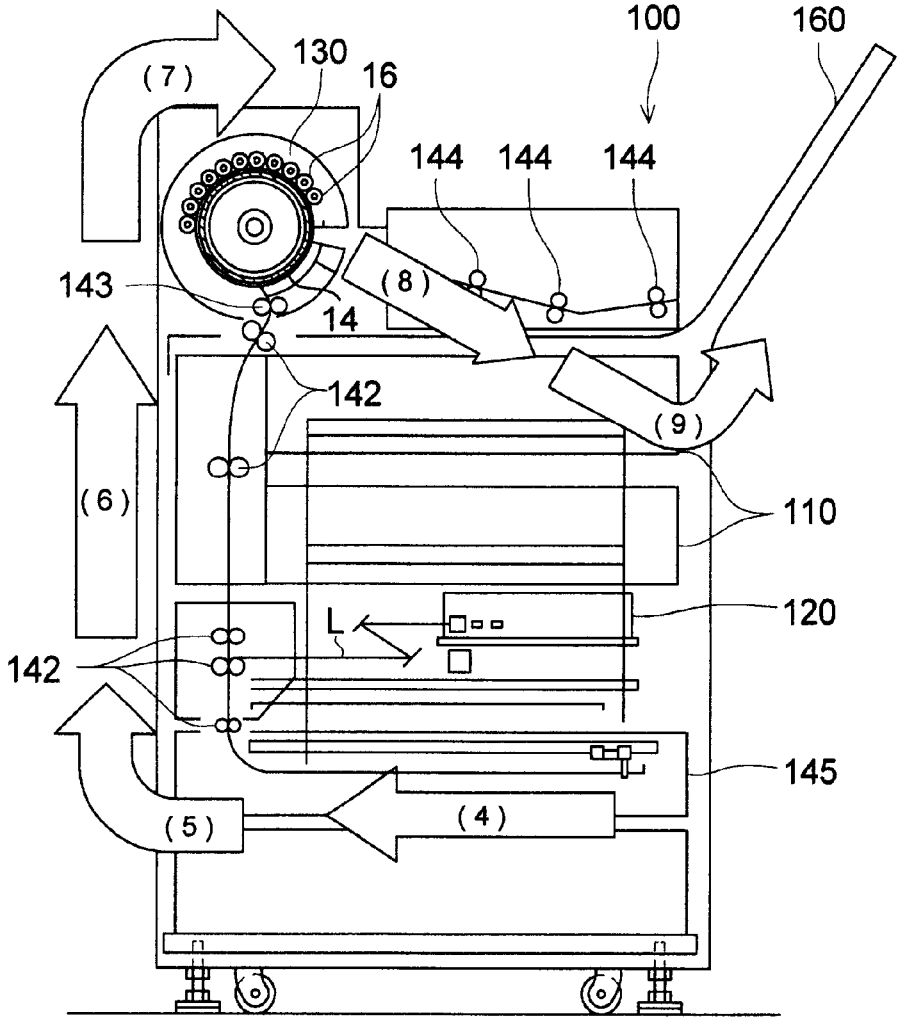
FIG. 1 is a front view of the thermal developing apparatus according an embodiment of the present invention.
Figure 2:
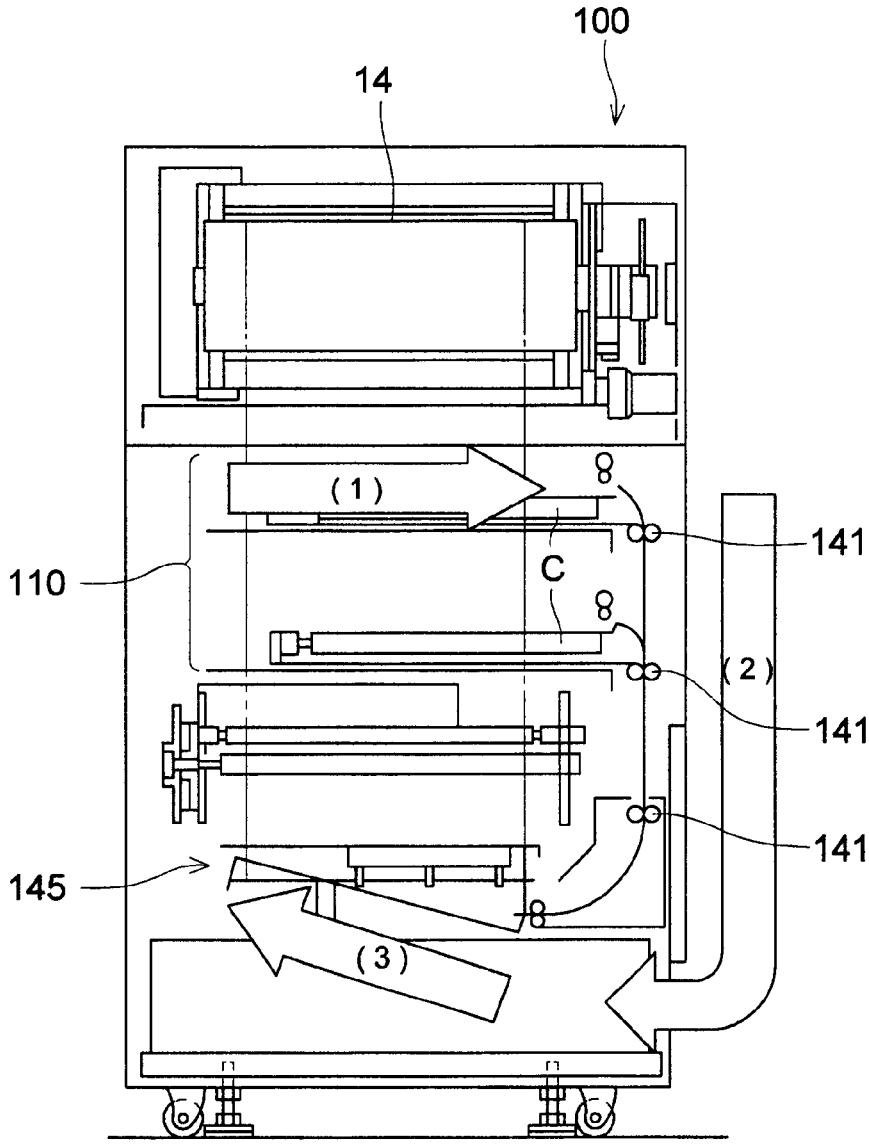
FIG. 2 is a left side view of the thermal developing apparatus according to the embodiment of the present invention.

An embodiment of the present invention will be described below. FIG. 1 is a front view of a thermal developing apparatus according to an embodiment of the present invention, and FIG. 2 is a left side view of such a thermal developing apparatus. A thermal developing apparatus 100 has a feeding section 110 to feed the film F which is the sheet-like photosensitive photothermographic element (photosensitive thermal developing sheet) one by one sheet, an exposure section 120 to expose the fed film F, and a developing section 130 to develop the exposed film F. Referring to FIGS. 1 and 2, the thermal developing apparatus 100 will be described below.

In FIG. 2, the feeding section 110 is provided in the upper and lower 2 stages, and houses the film F (refer to FIGS. 3 and 4) accommodated in the case C together with the case C. By a taking out apparatus, not shown, the film F is taken from the case C, and drown out in the direction (horizontal direction) shown by an arrow (1) in the drawing. Further, the film F drown from the case C is conveyed in the direction (downward) shown by an arrow (2) in the drawing by a conveying apparatus 141 composed of a roller pair.

The film F conveyed downward the thermal developing apparatus is further conveyed toward a conveyance direction conversion section 145 which is placed in a lower portion of the thermal developing apparatus 100, and the conveyance direction is converted by the conveyance direction conversion section 145 (arrow (3) in FIG. 2 and an arrow (4) in FIG. 1), and enters into an exposure preparation stage. Further, the film F is conveyed to the direction shown by an arrow (5) (upward in FIG. 1) from the left side of the thermal developing apparatus 100 by the conveyance apparatus 142 composed of the roller pair, and at the time, it is scanning-exposed by the laser light L within the range of the infrared area 780–860 nm, for example, the laser light of 810 nm from the exposure section 120.

When the film F receives the laser light L, a latent image is formed in a mode which will be described later. After that, the film F is conveyed to the direction (upward) shown by an arrow (6) in FIG. 1, and at the time point at which it reaches the conveying roller pair 143, it is supplied to the drum 14 as it is. That is, it is supplied at the random timing. Further, at the time point at which it reaches the conveying roller pair 143, it may be stopped once. In this case, the conveying roller pair 143 has a function to determine the supply timing of the film F onto the drum 14 of the developing section 130 rotating at a predetermined rotation speed, and when it is rotated to the next supplied position on the periphery of such a drum 14, the conveying roller pair 143 starts the rotation, and thereby the film F may be supplied onto the outer periphery of the drum 14. The specific structure will be described later.

Further, while the drum 14 holds the film F on the outer periphery of the drum 14, it is rotated in the direction shown by an arrow (7) in FIG. 1. In this condition, the drum 14 heats and thermally develops the film F, and in the mode which will be described later, the visual image is formed from the latent image. After that, when it is rotated to the right side of the drum in FIG. 1, the film F is separated from the drum 14, and after the film F is conveyed in the direction shown by an arrow (8) in FIG. 1 and cooled, it is conveyed in the direction shown by an arrow (9) in FIG. 1 by a plurality of conveying roller pairs 144, and delivered onto the delivery tray 160 so that it can be taken from the upper portion of the thermal developing apparatus 100.

Figure 3:
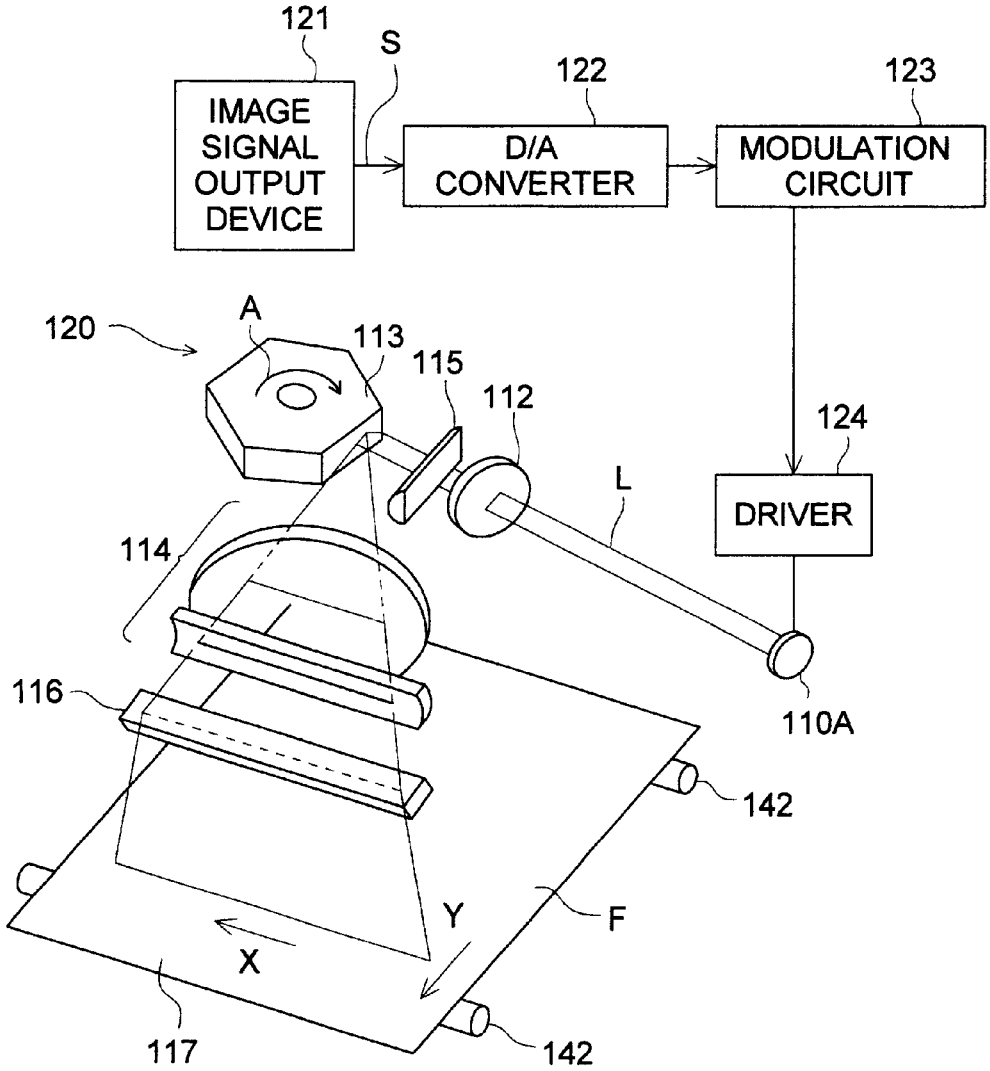
FIG. 3 is an outline view showing the structure of exposure section 120 in the thermal developing apparatus in FIG. 1.

FIG. 3 is an outline view showing the structure of the exposure section 120. The exposure section 120 deflects the laser light whose intensity is modulated according to the image signal S by the rotating polygonal mirror 113, and main scans on the film F, and the film F is sub-scanned by relatively moving it in the almost right angled direction to the main scanning direction to the laser light L, and the latent image is formed on the film F by using the laser light.

More specific structure will be described below. In FIG. 3, the image signal S which is a digital signal outputted from an image signal output apparatus 121 is converted into an analog signal by a D/A converter 122 and inputted into a modulation circuit 123. The modulation circuit 123 controls a driver 124 of a laser light source section 110A according to such an analog signal, and the modulated laser light L is radiated from the laser light source section 110A.

The laser light L radiated from the laser light source section 110A is converged into only the upper and lower directions by the cylindrical lens 115 after it penetrates a lens 112, and onto the rotating polygonal mirror 113 rotating in an arrow A direction in the drawing, it is incident as a line image perpendicular to its drive axis. The rotating polygonal mirror 113 deflects the laser light L in the main scanning direction by reflection, and after the deflected laser light L passes through an fθ lens 114 including the cylindrical lens formed by the combination of two lenses, it is reflected by a mirror 116 extending in the main scanning direction on the optical path, and it repeatedly main scans in the arrow X direction on the scanned surface 117 of the film F which is conveyed (sub-scanned) in the arrow Y direction by the conveyance apparatus 142 composed of conveying roller pair. That is, the laser light L scans over the whole surface of the scanned surface 117 on the film F.

The cylindrical lens of the fθ lens 114 converges the incident laser light L onto the scanned surface 117 of the film F only in the sub scanning direction, and further, the distance from the fθ lens 114 to the scanned surface 117 is equal to the focal distance of the whole fθ lens 114. As described above, in the present exposure section 120, the fθ lens 114 including the cylindrical lens and a mirror 116 are arranged, and the laser light L is temporarily converged only in the sub-scanning direction on the rotating polygonal mirror 113, and even when the surface tilting or axis deviation is generated in the rotating polygonal mirror 113, on the scanned surface 117 of the film F, there is no case where the scanning position of the laser light is dislocated to the sub-scanning direction, and the scanning lines of equal pitch can be formed. The rotating polygonal mirror 113 has an advantage that the scanning stability is more excellent than other light deflector such as, for example, the galvanometer mirror. In the manner as described above, the latent image according to the image signal S is formed on the film F. In this connection, referring to FIGS. 7(*a*) and 7(*b*), the content of the specific chemical reaction in which the latent image is formed will be described later.

Figure 4:
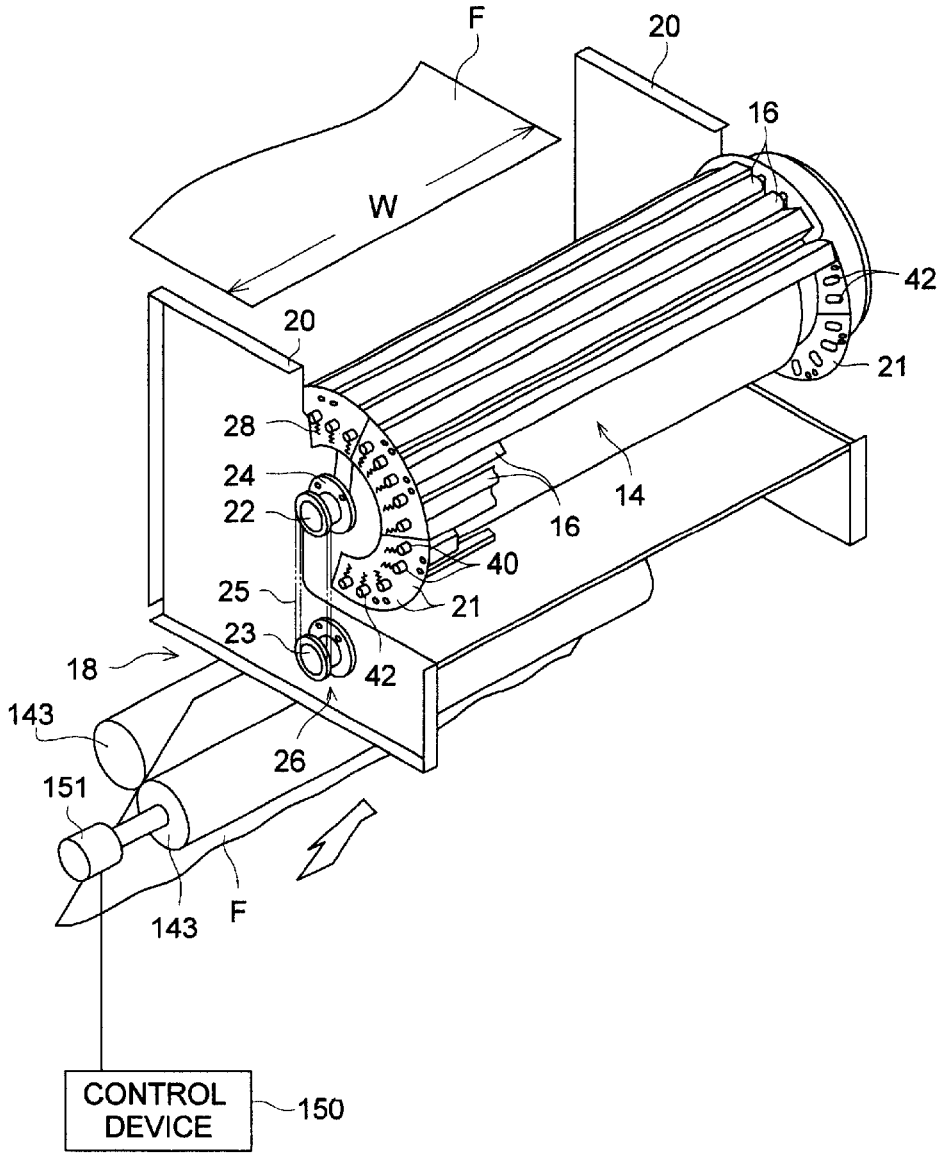
FIG. 4 is a view showing the structure of a developing section 130 to heat the film F in the thermal developing apparatus in FIG. 1, and a perspective view of the developing section 130.
Figure 5:
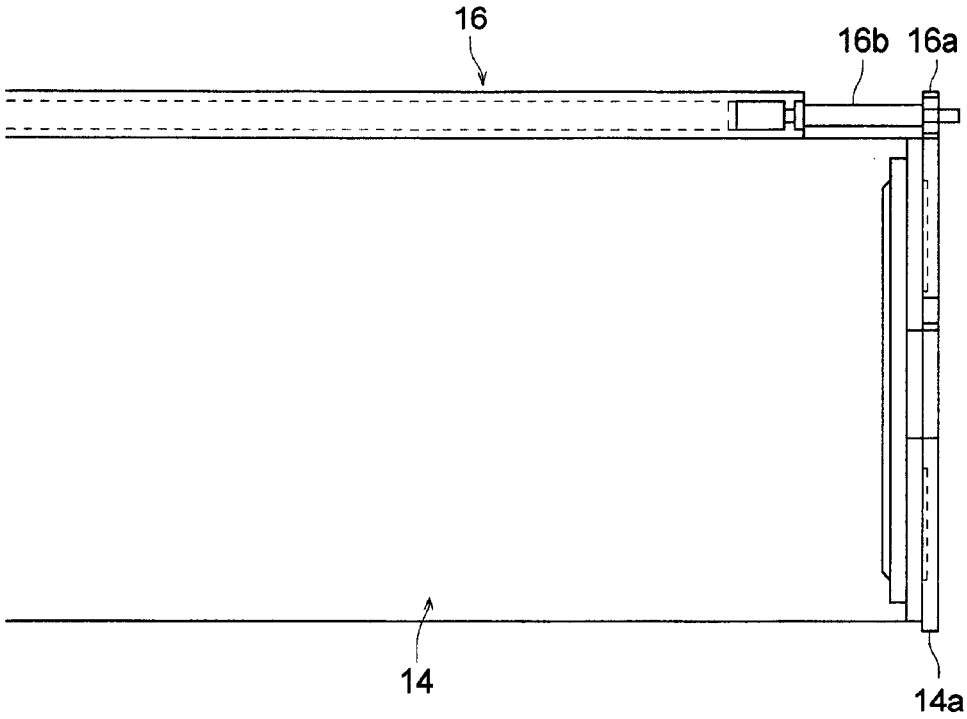
FIG. 5 is a front view showing a drum 14 and roller 16 of the developing section in the thermal developing apparatus in FIG. 1.
Figure 6:
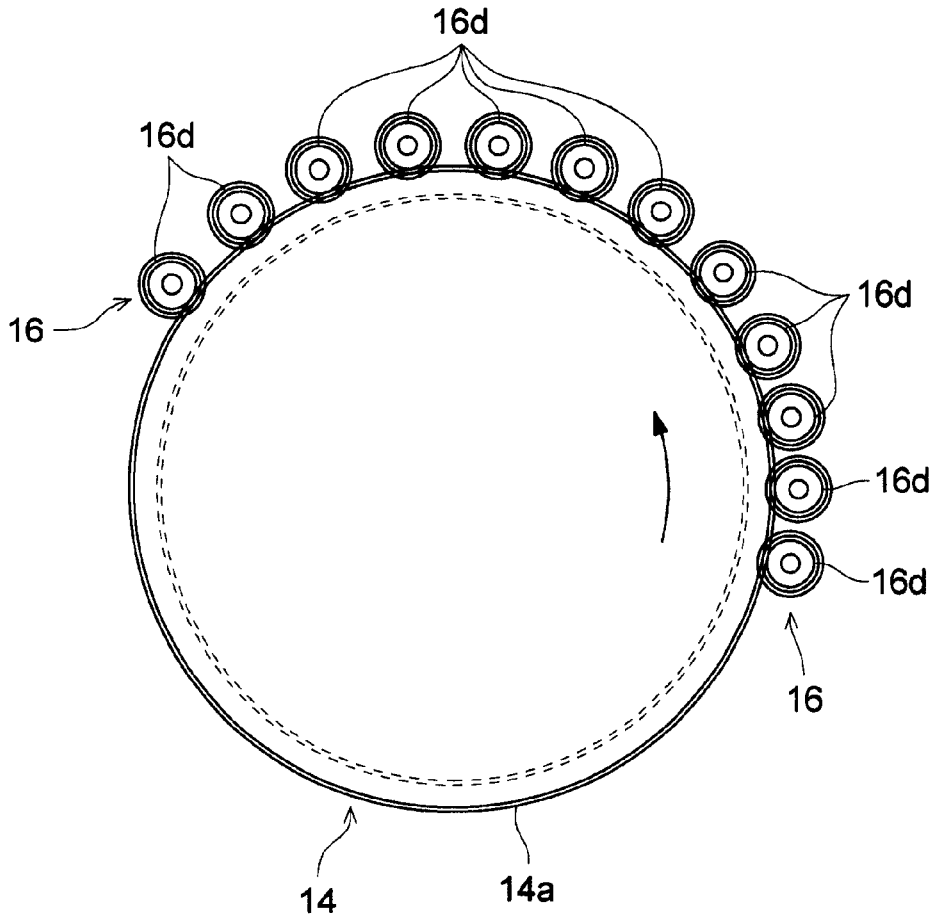
FIG. 6 is a side view of the drum 14 in FIG. 5.
Figure 7:
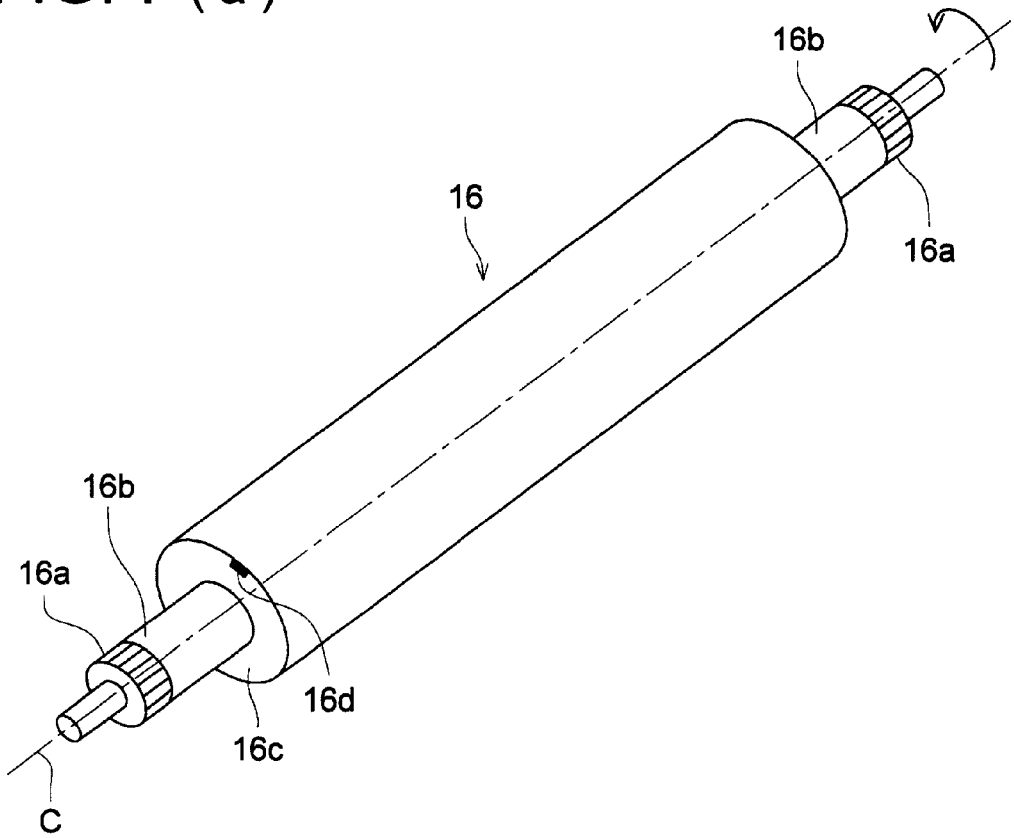
FIGS. 7(*a*) and 7(*b*) are perspective view and a sectional view of the roller 16 in FIG. 5.
Figure 7:
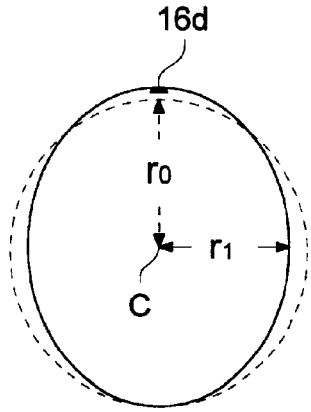

FIG. 4 to FIG. 7(*b*) are views showing the structure of the developing section 130 to heat the film F, and more specifically FIG. 4 is a perspective view of the developing section 130, FIG. 5 is a front view showing the drum 14 and roller 16 of the developing section, FIG. 6 is a side view of the drum 14 of FIG. 5, and FIGS. 7(*a*) and 7(*b*) are a perspective view FIG. 7(*a*) and a sectional view FIG. 7(*b*) of the roller 16.

Figure 8:
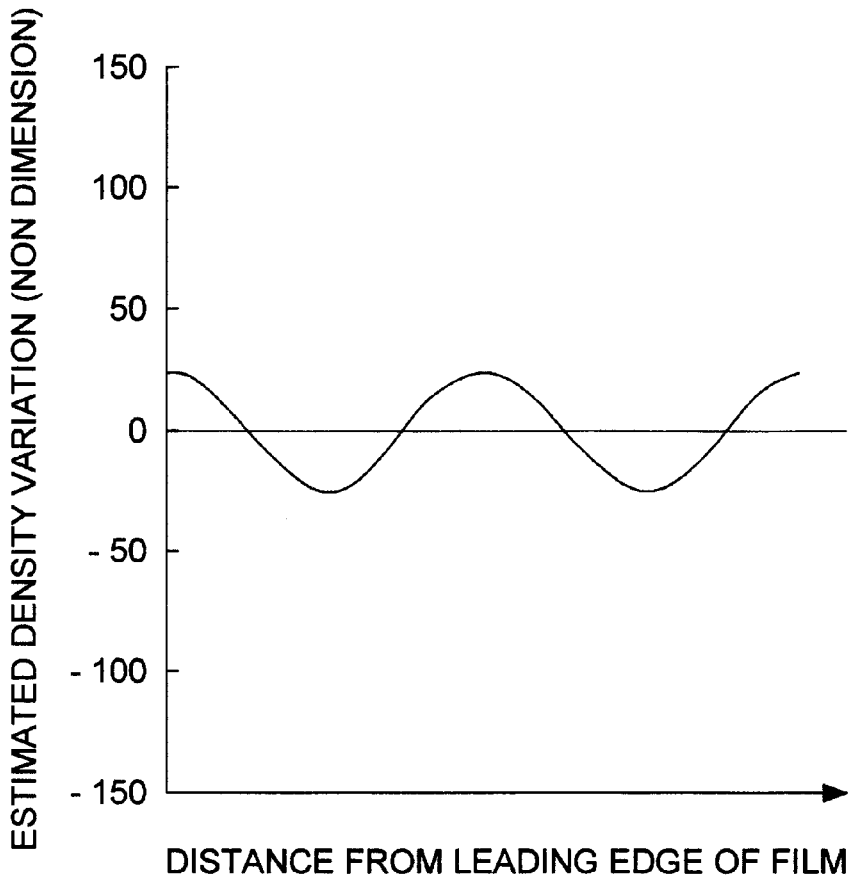
FIG. 8 is a view for explaining the effect of the present embodiment, and when the roller diameter in FIG. 7(*a*) and 7(*b*) is 12 mm, and the maximum value of the eccentricity of the roller is 100 $\mu$m, it is a view showing the relationship of the distance from the leading edge of the film and the presumed film density variation.

The developing section 130 has a drum 14 as the heated member which can heat the film F while the drum holds it by almost closely adhering onto the outer periphery of the drum. The drum 14 has a function to form the formed latent image as the visual image onto the film F by maintaining for a predetermined thermal developing time period at more than the predetermined lowest thermal developing temperature. Herein, the lowest thermal developing temperature is the lowest temperature at which the latent image formed on the film F begins to be thermally developed, and in the film of the present embodiment, it is more than 100° C. On the one hand, the thermal developing time period is a time period to maintain it at more than the lowest thermal developing temperature, in order to develop the latent image of the film F into the desired developing characteristic. In this connection, it is preferable that the film F is not practically thermally developed at lower than 40° C. Referring to FIG. 8, the specific content of the chemical reaction in which the latent image is converted into the visual image by the heating, will be described later.

The developing section 130 is assembled in the thermal developing apparatus 100 together with the exposure section 120, in the present embodiment, however, it may be an independent apparatus of the exposure section 120. In this case, it is preferable that there is a conveyance section by which the film F is conveyed from the exposure section 120 to the developing section 130.

Outside the drum 14, 12 small diameter rollers 16 as a guiding member and an urging member, are provided, and are parallelly opposite to the drum 14, and arranged in the peripheral direction of the drum 14 at an equal interval. On both ends of the drum 14, the guide brackets 21 supported by the frame 18 are provided every 3 pieces on a single side. In this connection, by combining the guide brackets 21, on both ends of the drum 14, the opposite C letter shapes are formed. In this connection, the number of the rollers 16 can be appropriately increased or decreased.

Each guide bracket 21 forms 9 long holes 42 extending in the radius direction. From this long hole 42, shafts 40 provided on both end portions of the roller 16 protrude. To shafts 40, one end of the coil spring 28 is respectively attached, and the other end of the coil spring 28 is attached to the vicinity of the inner edge of the guide bracket 21. Accordingly, each roller 16 is urged onto the outer periphery of the drum 14 by the predetermined force according to the urging force of the coil spring 28. When the film F enters between the outer periphery of the drum 14 and the roller 16, it is pressed onto the outer peripheral surface of the drum 14 by such the predetermined force, thereby, the film F is wholly uniformly heated.

The shaft 22 coaxially connected to the drum 14 extends outward from an end portion member 20 of the frame 18, and by the shaft bearing 24, it is rotatably supported to the end portion member 20. On the rotation axis 23 of a micro-step motor 26 which is arranged lower the shaft 22 and attached to the end portion member 20, a gear (not shown in the drawing) is formed. On the one hand, a gear is also formed on the shaft 22. Through a timing belt (a belt on which a gear is notched) 25 which connects both gears, the motive power of the micro-step motor is transmitted to the shaft 22, thereby, the drum 14 is rotated. In this connection, the transmission of the motive power from the rotating axis 23 to the shaft 22 may be conducted through a chain or a gear train not through the timing belt.

As shown in FIG. 6, in the present embodiment, the rollers 16 are provided in the circumferential direction of the drum 14 over the angular range of about 170°. In the inner periphery of the drum 14, the plate-like heater is attached over the whole periphery, and heats the outer periphery of the drum 14. The diameter of the drum 14 is within the range of 80–200 mm.

The drum 14 is provided with an aluminum support tube, and an soft layer (elastic layer) attached onto the outside of this support tube. The soft layer may be indirectly attached onto the support tube. It is preferable that the unevenness of the wall thickness of the support tube is within, for example, 4%. Further, it is preferable that, in order to increase the adhesion to the film F to be heated, the soft layer has a sufficiently smooth surface, and its surface roughness Ra is not larger than 5 $\mu$m (particularly 2 $\mu$m).

However, it is preferable that the surface roughness Ra for the specific material which is formed of silicon rubber as a base is, in order to prevent the film F from adhering to the drum 14, not smaller than 0.3 $\mu$m. In this connection, when the surface roughness Ra is not smaller than 0.3 $\mu$m, the exhaust of the gas, particularly, the volatile material from between the soft layer and the film F becomes easy.

Because the soft layer is used, without sacrificing the wear resistance, the film F more surely close contacts with the drum 14 by the roller 16. It is preferable that the soft layer is not larger than 70 (particularly not larger than 60) in the shore A hardness which is measured by the durometer. In the present embodiment, the hardness is not larger than 55 in the shore A hardness measured by the durometer.

In the specific material, additives to increase the thermal conductivity and the silicon rubber are included, and it is found that such a material is particularly effective in order to form the soft layer. Although the thermal conductivity of the silicon rubber included in such a material is comparatively small, by the silicon rubber, the pressing performance of the film F and the durability (wear resistance) to the film F are increased.

On the one hand, in order to increase the processing ability of the development, it is necessary that the thermal conductivity is increased, and the additives in the above material contributes to maintain the thermal conductivity high. However, in the material forming the soft layer, when the addition amount of the additives is increased, because the pressing performance and the durability by the silicon rubber are decreased, it is necessary that the additives and addition amount of the silicon rubber are balanced within a certain degree of the range. In this connection, the silicon rubber contained material has an advantages that it is easily separated from the film F and chemically inactive.

It is preferable that the thickness of the soft layer is within the range of 0.1 mm to 2 mm, and although the thinner soft layer than that can be used, but, as it is thinner, there is a problem that the function of the soft layer is lowered, and the production becomes difficult. Therefore, it is preferable that the thickness of the soft layer is not smaller than 0.4 mm. Further, it is preferable when the fluctuation of the thickness of the soft layer is not larger than 20% (particularly not larger than 10%) on the surface area. In the present embodiment, it is suppressed to not larger than 5%.

In the present embodiment, the rotatable roller 16 is used as the guiding roller. However, another means such as a small movable belt can also be used. In the present embodiment, as the roller 16, the aluminum tube whose outside diameter is within the range of 8–30 mm and for example, 12 mm and wall thickness is 2 mm is used.

As described above, because the urging force of the coil spring 28 determines the pressure contact force of the roll 16 so that the film F is more surely adhered onto the outer peripheral surface of the drum 14 and can receive the sufficient thermal transmission, the caution is necessary for the selection of the value. When the urging force of the coil spring 28 is too small, there is a possibility that, because the heat is unevenly transmitted to the film F, the development of the image becomes imperfect. Accordingly, it is preferable that the urging force from the roller 16 per 1 cm width of the film F is not smaller than 3 gf (particularly smaller than 5 gf). Further, when the film F rotationally moved together with the drum 14, and the roller 16 is in contact with the film F, there is a possibility that the film F is scratched by the roller 16. Accordingly, it is necessary that the urging force of the coil spring 28 is small to the degree that the roller 16 does not generate the indentation on the film F.

Accordingly, it is preferable that the urging force from the roll 16 per 1 cm width of the film F is in the range of 3–7 gf per 1 cm width of the film F. Thereby, even when the foreign matter such as dust exists between the roller 16 and the film F, the roller 16 does not generate the indentation on the film F. In this connection, when each coil spring 28 is used for the roller 16 provided around the cylindrical shape drum 14, the urging force by each coil spring 28 may be determined by considering the gravity acting on each roller 16. For example, when the coil spring 28 urging the roller 16 positioned on the upper side of the drum 14 is made smaller urging force than another coil spring 28 urging the roller 16 at the bottom side of the drum 14 corresponding to the weight of the roller 16, the almost same surface pressure can be made to act on the whole of the film F.

In addition to the force to be acted by each roller 16, it can be said that the space between the roller 16 and the adjoining roller 16 is important for forming the high quality image in the film F. When the film F is supplied to the drum 14, the temperature is, generally, the room temperature (about 20° C.). Accordingly, in order to make the processing ability of the developing section 130 maximum, it is necessary that the film F is quickly heated from the room temperature to the minimum thermal developing temperature necessary for starting the development.

However, in the base material included in a some kind of film F, for example, a plate material in which the polyester film is a base, and a plate material in which other thermal plastic material is a base, there is a possibility that it is thermally expanded or contracted at the time of heating. Accordingly, it is necessary that the film F is uniformly heated so that the dimensional change is made uniform so as not to form the wrinkle (the crease) when the condition of the film F is alternately changed between the condition that it is held horizontally, and the condition in which it is not constrained. In order to realize it, the plurality of rollers 16 is provided with the space so that the change of the area of the film F positioned between the roller and the adjoining roller 16 can be allowed when the film F is not constraint between the roller 16 and the drum 14.

Further, as described above, in order to sufficiently and uniformly transmit the heat so that the film F is uniformly developed, it is necessary that the roller 16 holds the film F for a predetermined time period under the condition that it is guided to the drum 14. As the result, it is necessary that the space existing between the roller 16 and the adjoining roller 16 is selected so that the wrinkle (the crease) is minimum, and the heating of the film F is quickly and uniformly conducted.

Further, on the outer periphery of the cylindrical drum 14, by the stiffness of the film F itself, its front edge extends toward the tangential line direction of the nip portion between adjoining two rollers 16, however, in order to suppress it, it is necessary that the adjoining two rollers 16 are sufficiently close to each other. Such the arrangement is important in order to hold the film F between the roller 16 and the drum 14.

As shown in FIG. 6, for example, 12 rollers 16 are provided over about 159° in the rotating direction of the drum 14, and each space is spaced by about 15° from the center to the center of the roller. This structure effectively acts, when the diameter of the drum 14 is 15 cm–30 cm, and the diameter of the roller is 1–2 cm, on the film F whose thickness of the base is 0.1–0.2 mm, for example, comparatively hard film F such as polyester film whose base material thickness is 0.18 mm, or the film F whose hardness is smaller, such as polyester film whose base thickness is 0.10 mm.

A heater is mounted in the inner periphery of the drum 14, and heats the outer peripheral surface of the drum 14. As the heater to heat the drum 14, for example, a resistive foil heater which is etched can be used. Corresponding to the temperature information sensed by the temperature sensor provided on the drum 14, by adjusting the electric power supplied to the heater, the adjustment of the outer surface temperature is conducted so that it becomes the temperature appropriate for the development of the specific film F. In the present embodiment, the drum 14 can be heated to the temperature of 60° C.–160° C., and it is preferable that the temperature in the width direction of the drum 14 is maintained within 2° C. (particularly within 1.0° C.), and in the present embodiment, it is maintained within 0.5° C.

Further, as shown in FIG. 1 and FIG. 4, in a conveying roller pair 143 which is arranged on the upstream side of the drum 14 (lower side in the drawing) and sends the film F to the drum of the developing section 130, its one roller is rotated by a motor 151 and the motor 151 is controlled by a control apparatus 150, and the timing of its rotation and the rotation speed are controlled.

As shown in FIG. 5, the gear teeth 14*a* are provided on the both ends of the drum 14 as the rotation transmission section of the roller, and as shown in FIG. 5, FIG. 7(*a*), the gear teeth 16*a* as the rotated transmission section are provided through a small diameter portion 16*b* on both ends of each roller 16, and these gear teeth 14*a* and the gear teeth 16*a* are engaged. Thereby, because the rotation of the drum 14 is transmitted to each roller 16 through the gear teeth 16*a* of the rotated transmission section, each roller 16 is surely rotated and not stopped by the slip.

The roller 16 is not a true circle as shown by the sectional view of the roller 16 in FIG. 7(*b*) due to the fluctuation in the production (the circle of the radius r0 as shown by a dotted line), and the actual radius r1 is varied to the nominal (design) radius r0. As shown in FIG. 7(*a*), the roller 16 is rotated around the rotation axis c, and at the time of the rotation, the eccentricity in which the outer peripheral surface of the roller 16 changes by the variation value σ of the radius (=r1−r0) to the rotation axis c, is generated. The eccentricity in one sectional view as shown in FIG. 7(*b*), shows the same tendency in the whole longitudinal direction of the roller 16. As the result, in FIG. 5, the pressing force when the film is pressed by the urging force of the coil spring 28 in FIG. 4 under the condition that film is nipped between the drum 14 and the roller 16, changes in accordance with the eccentricity. When such the change of the pressing force is considered for the whole of 12 rollers, the period of the radius variation value σ of each roller is synchronized, and there is a case that, in certain straight line portion in the width direction of the film tangent to the longitudinal direction of the roller 16, for example, the film passes the drum 14 under the condition that only the minimum pressing force is applied, and in another straight line portion, only the maximum pressing force is applied. Therefore, the present inventors find that the adhesion of the film to the outer peripheral surface of the drum 14 is varied and it is a cause of the uneven development, and the present invention is attained according to such the knowledge.

That is, in the present embodiment, the eccentricity of each roller 16 is measured at the time of production, and as shown in FIGS. 7(*a*) and 7(*b*), the reference marker 16*d* is formed by the stamping or printing at the position on the circumference at which, for example, the radius r1 is the maximum at the end surface 16*c* of the step difference portion, and as shown in FIG. 6, a plurality of rollers 16 are aligned by respectively shifting the phase from the upstream side by making each reference marker 16*d* the index so that the reference marker 16*d* is not synchronized while each roller 16 is rotated. When the plurality of rollers 16 are aligned in this manner, in the arbitrary straight line portion of the width direction of the film tangent to the longitudinal direction of the roller 16, the pressing force onto the film is different for each roller in such a manner that, when the minimum pressing force is applied on a certain roller, the maximum pressing force is applied on another roller, and further, on the other roller, the intermediate pressing force is applied. When the film passes on the drum 14 under the condition that the pressing force by each roller is varied, because the plurality of rollers 16 uniformly press the film onto the drum 14 on the whole, the thermal energy which is obtained by the film from the drum 14 becomes constant, and the uneven development hardly occurs.

Further, because the reference markers 16*d* of the plurality of rollers 16 are provided, at the apparatus production or the assembling at the time of the maintenance, because the reference markers 16*d* can be made the index for the positioning of each roller, the phase adjustment for each roller becomes simple, and the assembling of the roller becomes easy. Thereby, the reproducibility of the alignment of the roller is increased, and the reproducibility and the stability of the image quality can be secured at the time of production and the maintenance of the apparatus.

Figure 9:
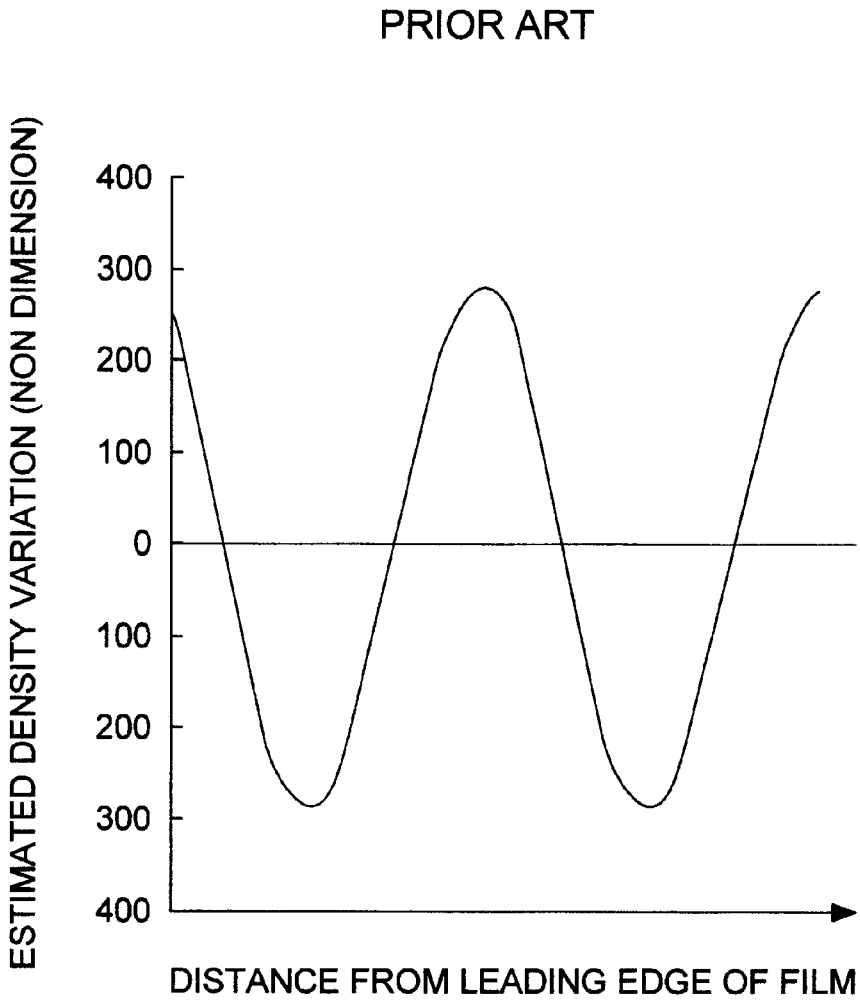
FIG. 9 is the similar view to FIG. 8 at the time of the conventional roller arrangement.

Referring to FIG. 8 and FIG. 9, the effect of the present embodiment described above will be further described. FIG. 8 is, in the present embodiment, when the roller diameter is 12 mm, the maximum value of the eccentricity is 100 μm in the reference marker 16*d* in FIGS. 7(*a*) and 7(*b*), a view presumed according to the radius variation value how is the variation of the density in the width direction straight line portion expressed by the distance from the leading edge of the film, and FIG. 9 is the similar view when the roller alignment is the conventional one.

As can be seen from FIG. 8, the presumed density change width in the present embodiment in which the rollers 16 are aligned by respectively shifting the phases so that the reference markers 16*d* are not synchronized while each roller 16 is rotated as described above, is decreased to a value not larger than 1/10 as compared with a case of FIG. 9 of the roller alignment as in the conventional one in which the phases are synchronized.

As described above, the film F is moved around the drum 14 accompanied by its rotation while the film F is guided onto the drum 14 by the plurality of rollers 16, and during the movement, the film F is brought into contact with the outer peripheral surface of the drum 14 for a predetermined time period, uniformly heated, and thermally developed without generating the uneven development. Specifically, for example, when the film F in which the photosensitive thermal developing emulsion including the infrared ray photosensitive silver halide is coated on the PET (polyethylene terephthalate) as 0.178 mm base material, is developed, the outer peripheral surface of the drum 14 is maintained at 120° C., and the film F is rotated for the predetermined 15 seconds at the rotation speed at which the film F is held under the condition that it is in contact with the outer peripheral surface. The temperature of the film F is increased to the value of 120° C. at the predetermined time period and the temperature. In this connection, the glass transition temperature of PET is about 80° C. Further, it is preferable that the surface of the side having the photosensitive thermal developing emulsion layer of the film F is brought into contact with the outer peripheral surface of the drum 14 (in the present embodiment, the soft layer).

Figure 10:
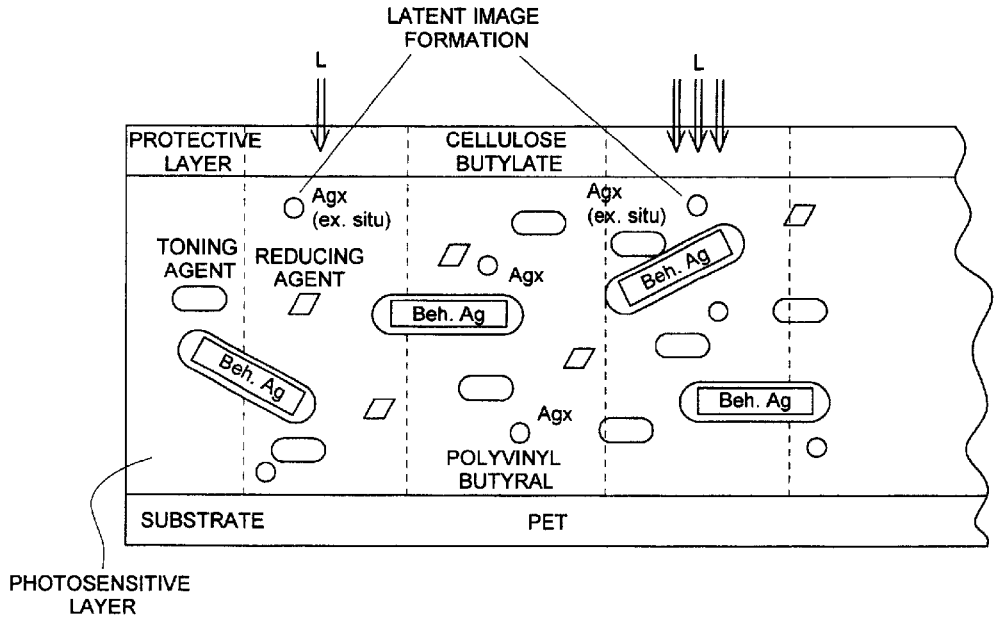
FIG. 10 is a sectional view of the film F, and a view which typically shows the chemical reaction in the Film F at the time of the exposure.
Figure 11:
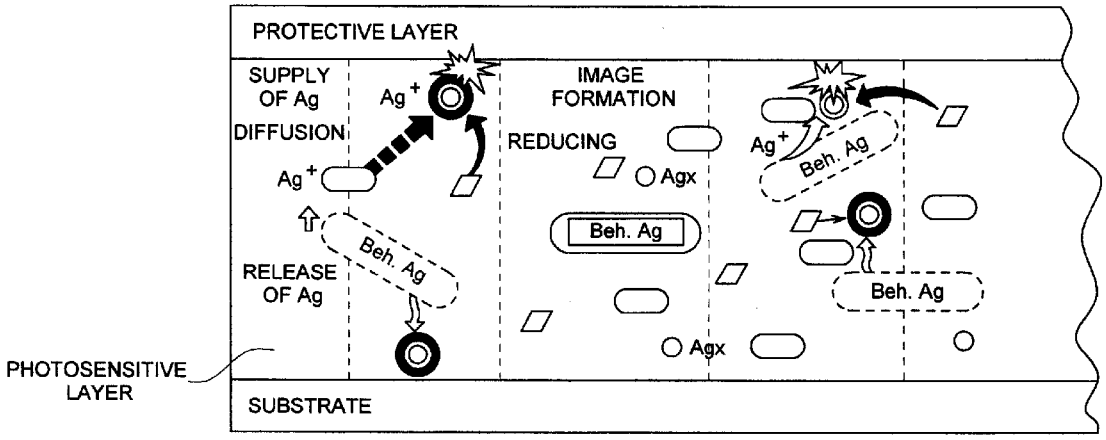
FIG. 11 is a similar sectional view to FIGS. 7(*a*) and 7(*b*), which typically shows the chemical reaction in the film F at the time of heating.

FIG. 10 is a sectional view of the film F shown in the example, and a view typically showing the chemical reaction in the film F at the time of the exposure. FIG. 11 is a similar sectional view to FIG. 10 typically showing the chemical reaction in the film F at the time of the heating. In the film F, the photosensitive layer in which the heat resistive binder is a main component, is formed on the base material (base layer) formed of PET, and further, the protective layer in which the thermal resistive binder is a main component is formed thereon. In the photosensitive layer, silver halide particle, silver behenate (Beh. Ag) which is a kind of an organic acid silver salt, and the reduction agent and toning agent are blended. Further, also on the rear surface of the base material, the rear surface layer in which the heat resistive binder is a main component is provided.

When the laser light L is radiated onto the film F from the exposure section 120 at the time of the exposure, as shown in FIG. 10, in the area on which the laser light L is radiated, the silver halide particle is exposed and the latent image is formed. On the one hand, as described above, when the film F is heated and becomes more than the lowest thermal developing temperature, as shown in FIG. 11, the silver ion (Ag+) is emitted from silver behenate, and the silver behenate from which the silver ion is emitted forms the toning agent and complex. After that, it is considered that the silver ion is diffused and the reduction agent acts by making the exposed silver halide particle as the core, and by the chemical reaction, the silver image is formed. In this manner, the film F includes the photosensitive silver halide particle, organic silver salt and silver ion reduction agent, and under the temperature not higher than 40° C., it is not actually thermally developed, and thermally developed at the temperature not lower than the lowest developing temperature which is not lower than 80° C.

Next, a modified example of the present embodiment will be described. In the present example, in FIG. 7(*b*), the eccentricity is decreased so that the radius variation value $\sigma$ of the roller to the roller diameter $\Phi$ ($=2\times r0$) satisfies the next expression (1).

$$\sigma<\Phi\times 0.1/12 \quad (1)$$

For example, when the diameter $\Phi$ of the roller 16 is 12 mm, the radius variation value $\sigma$ of the roller is not lager than 0.1 mm, and because the film is uniformly pressed onto the drum 14 by the plurality of roller 16, the thermal energy which is obtained by the film from the drum 14 becomes constant, and the uneven development hardly generates. In this connection, in order to further obtain this effect, it is further preferable that the next expression (2) is satisfied.

$$\sigma<\Phi\times 0.05/12 \quad (2)$$

Figure 12:
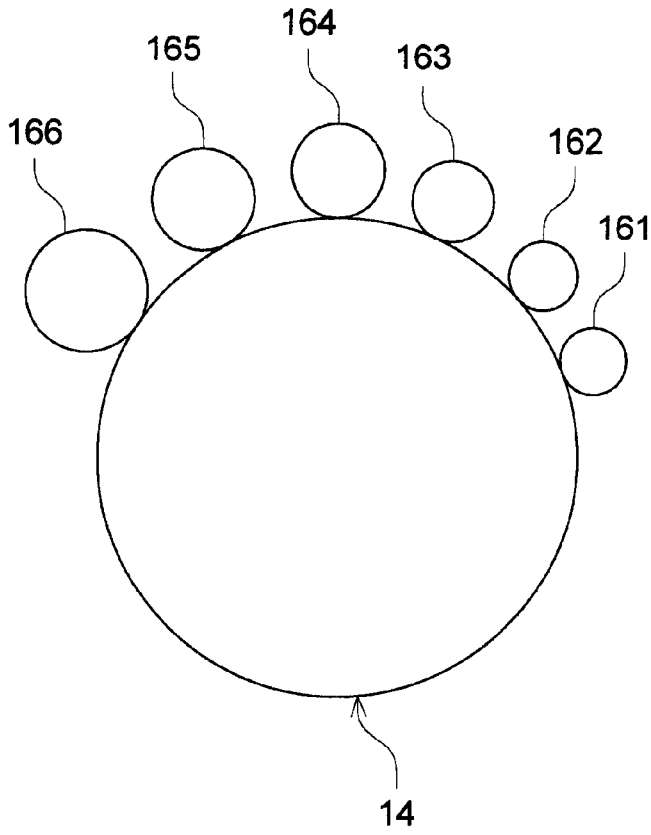
FIG. 12 is a view showing a modified example of the present embodiment, and a front view showing the drum 14 and different diameter rollers 161–166.

Next, referring to FIG. 12, another modified example will be described. This example is structured in such a manner that respective diameters of a plurality of rollers 161–166 are different. Thereby, even when the plurality of rollers generate the eccentricity, because their variation cycles are not synchronized, the radius variation is cancelled as a whole on the film during the rotation of the plurality of rollers, and the film is more uniformly pressed on the drum 14 by the plurality of rollers 161–166. Further, because the plurality of rollers whose diameters are different may be aligned at random, the assembly becomes easy. Further, the order of alignment of the plurality of rollers whose diameters are different may be applied at random, and the number of rollers can also be appropriately increased or decreased.

The present invention is described by using the embodiments as above, however the present invention is not limited to those, but each kind of modification may be possible within the scope of technical idea of the present invention. For example, the structural material of the drum and roller is not limited to the material of the present embodiment, but it is of course that these may be another material. Further, the developing section 130, in the present embodiment, is assembled in the thermal developing apparatus 100 together with the exposure section 120, however, it may be a separate structure from the exposure section 120. In such the case, a conveying section by which the film F is conveyed from the exposure section 120 to the developing section 130, is necessary.

Further, the heated member may not always be drum-like, and for example, the photothermographic element may be conveyed on a plane-like heated member, and further, the conveying drive means of the photothermographic element may be provided on one or both of the heated member and guiding roller.

According to the thermal developing apparatus and assembling method thereof, the thermal energy obtained from the heated drum by the photothermographic element is uniformed, the fluctuation of the uneven development for each apparatus can be decreased, and the reproducibility and stability of the image quality at the time of the production of the apparatus and at the time of the maintenance can be secured.

What is claimed is:

1. A thermal developing apparatus for thermally developing a photothermographic element having a latent image thereon to obtain a visible image, comprising:

(a) a heated member positioned to receive said photothermographic element and to heat said photothermographic element to develop an image on said photothermographic element; and (b) a plurality of guiding rollers positioned at guiding positions adjacent said heated member to guide said photothermographic element against said heated member, wherein said photothermographic element is transported between said heated member and said guiding rollers while said guiding rollers rotate, and wherein said guiding rollers are arranged by shifting an outer circumferential position of each guiding roller at which each roller has a maximum radius, to each other so that a variation cycle of a radius of each guiding roller is not synchronized with each other on the photothermographic element during the transportation of said photothermographic element.

2. The thermal developing apparatus of claim 1, further comprising a drive transmitter provided between said heated member and said guiding rollers.

3. The thermal developing apparatus of claim 1, wherein each of said guiding rollers comprises a reference marker at which a phase of the variation cycle of the radius of each guiding roller is adjusted on said photothermographic element.

4. A thermal developing apparatus for thermally developing a photothermographic element having a latent image thereon to obtain a visible image, comprising:

(a) a heated member positioned to receive said photothermographic element and to heat said photothermographic element to develop an image on said photothermographic element; and (b) a plurality of guiding rollers positioned at guiding positions adjacent said heated member to guide said photothermographic element against said heated member, wherein said photothermographic element is transported between said heated member and said guiding rollers while said guiding rollers rotate, and wherein the following expression is satisfied, $$\sigma<\Phi\times 0.1/12$$

where $\Phi$ represents a diameter of each guiding roller, and a represents a variation value of a radius of each guiding roller.

5. The thermal developing apparatus of claim 4, wherein said diameter of each of said guiding rollers is different from each other.

6. An assembling method of a thermal developing apparatus for thermally developing a photothermographic element having a latent image thereon to obtain a visible image, the thermal developing apparatus comprising a heated member positioned to receive said photothermographic element and to heat said photothermographic element to develop an image on said photothermographic element; and a plurality of guiding rollers positioned at guiding positions adjacent said heated member to guide said photothermographic element against said heated member, wherein said photothermographic element is transported between said heated member and said guiding rollers while said guiding rollers rotate, and each of said guiding rollers having a reference marker at which a phase of a variation cycle of a radius of each guiding roller is adjusted on the photothermographic element, the assembling method at the time of production and maintenance of the apparatus comprising the steps of:

(a) adjusting the phase of the variation cycle of the radius of each guiding roller on the basis of the reference marker; and (b) arranging said guiding rollers by shifting an outer circumferential position of each guiding roller at which each roller has a maximum radius, to each other so that the variation cycle of the radius of each guiding roller is not synchronized with each other on the photothermographic element during the transportation of said photothermographic element.

7. The assembling method of claim 6, comprising the additional steps of measuring a variation value of the radius of each guiding roller at the time of production of the thermal developing apparatus, and providing the reference marker on the basis of the measured value.

* * * * *